United States Patent [19]

Le Roux et al.

[11] Patent Number: 4,724,055

[45] Date of Patent: Feb. 9, 1988

[54] CONTINUOUS PRODUCTION OF LITHIUM METAL BY ELECTROLYSIS OF LITHIUM CHLORIDE

[75] Inventors: Eric Le Roux, Paris; Philippe Nataf, Ville D'Avray; Serge Jacubert, Viroflay, all of France

[73] Assignee: Rhone-Poulenc Specialites Chimiques, Courbevoie, France

[21] Appl. No.: 941,314

[22] Filed: Dec. 15, 1986

[30] Foreign Application Priority Data

Dec. 13, 1985 [FR] France ..... 85 18483

[51] Int. Cl.[4] ..... C25C 3/02

[52] U.S. Cl. ..... 204/68; 204/247

[58] Field of Search ..... 204/68, 245, 247

[56] References Cited

U.S. PATENT DOCUMENTS 4,617,098 10/1986 Verdier et al. ..... 204/68

*Primary Examiner*—R. L. Andrews

*Attorney, Agent, or Firm*—Burns, Doane, Swecker & Mathis

[57] ABSTRACT

Lithium metal is continuously prepared, in specially adapted electrolytic cell, by (i) continuously electrolyzing a mixture of molten salts including lithium chloride, said mixture comprising the medium of electrolysis, (ii) continuously withdrawing admixture of product lithium metal with said mixture of molten salts, and (iii) continuously discharging formed chlorine gaseous phase therefrom, wherein the medium of electrolysis is maintained at a temperature ranging from the melting point of said mixture of molten salts, at the eutectic composition thereof, to 400° C., and said gaseous chlorine phase is maintained at a temperature not exceeding 300° C.

10 Claims, 1 Drawing Figure

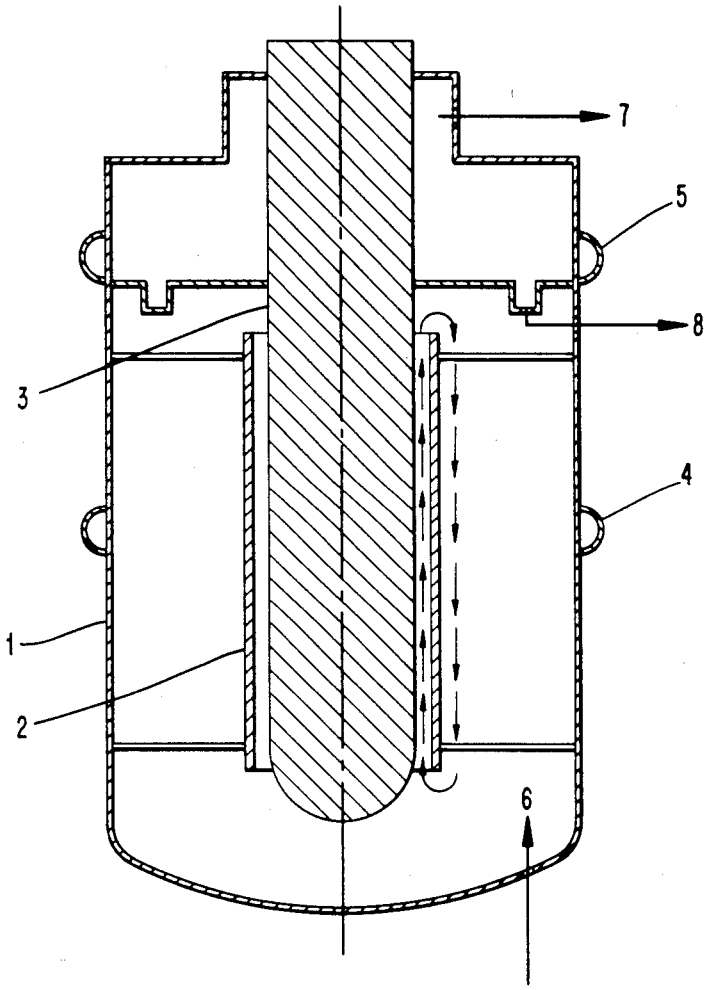
7
5
8
3
4
1
2
6

CONTINUOUS PRODUCTION OF LITHIUM METAL BY ELECTROLYSIS OF LITHIUM CHLORIDE

BACKGROUND OF THE INVENTION

1. Field of the Invention

The present invention relates to process and apparatus for the continuous preparation of lithium by the electrolysis of lithium chloride contained in a mixture of molten salts.

2. Description of the Prior Art

Published French Patent Applications Nos. 2,532,332 and 2,560,221 describe the continuous production of lithium metal by the electrolysis of lithium chloride in a mixture of molten salts, at a temperature of 400° to 500° C., without separating the metallic lithium from the mixture of molten salts in the electrolyzer.

However, at these temperatures such a process does not prevent the corrosion by gaseous chlorine of that portion of the body of the electrolytic cell which is situated above the level of the electrolytic bath; in effect, this portion of the cell is particularly sensitive to corrosion, because it is within the zone in which the chlorine temperature is the highest. Cf. U.S. Pat. No. 4,617,098.

SUMMARY OF THE INVENTION

Accordingly, a major object of the present invention is the provision of improved process/apparatus which obviates the corrosion drawback of the prior art, while at the same time even enhancing the productivity of the electrolytic cell.

Briefly, the present invention features the continuous preparation of lithium metal by the electrolysis of lithium chloride in a mixture of molten salts, and wherein the electrolytic medium naturally circulates between the cell electrodes without any diaphragm being disposed therebetween. The lithium metal is continuously recovered in a mixture of molten salts, on the one hand, and chlorine in the gaseous form is continuously recovered on the other. The subject process is characterized in that the electrolytic medium is maintained at a temperature ranging from the melting point of the mixture of molten salts at the eutectic composition and 400° C., and in that the gaseous phase comprising the formed chlorine is maintained at a temperature which does not exceed 300° C.

BRIEF DESCRIPTION OF THE DRAWING

The FIGURE of Drawing is a diagrammatic/-schematic cross-sectional view of suitable apparatus/-process according to the invention.

DETAILED DESCRIPTION OF THE PREFERRED EMBODIMENTS OF THE INVENTION

More particularly according to the present invention, the electrolytic medium advantageously comprises a mixture of molten salts based on lithium chloride and at least one other alkali or alkaline earth metal chloride, which, together with the lithium chloride, forms a eutectic mixture melting at a temperature ranging from about 320° to 360° C. As a representative binary mixture, lithium chloride and potassium chloride are exemplary. Exemplary ternary fixtures are those containing, in addition to lithium chloride and potassium chloride, a chloride selected from among the chlorides of sodium, rubidium, strontium, magnesium, calcium and barium.

The mixture of molten salts charged to the electrolytic cell should have a composition rather close to the eutectic composition of the mixture employed, with an excess of the lithium chloride subjected to electrolysis. Thus, for example, if, as the electrolysis medium, a mixture of lithium chloride and potassium chloride is used, it is considered that at approximately 380° C. the amount of lithium chloride in said mixture could vary at the inlet and the outlet between 57 and 63% by mole of LiCl in the mixture of molten salts, with the concentration at the inlet being higher than the concentration at the outlet. In this case, lithium chloride may be present in an excess of up to 5% relative to the eutectic composition of the molten lithium chloride/potassium chloride admixture.

The temperature of the electrolytic bath is typically from 10° to 60° C. higher than the melting temperature of the eutectic composition of the mixture of molten salts, but less than 400° C.

A distinguishing feature of the subject process, i.e., to maintain the temperature of the electrolysis bath lower than 400° C. and the temperature of the gaseous phase lower than 300° C., is intended, on the one hand, to prevent the corrosion of the electrolytic cell by chlorine, by effecting formation of a peripheral crust of crystallized salts on the inner wall surface of the electrolyzer at the level of the gas/liquid interface where the temperature of the gas is the highest, and on the other hand, to improve the productivity of the electrolyzer by enabling an increase in the intensity of the electrolytic current.

The gaseous phase thus has a temperature gradient extending over a range of from 300° C. to ambient temperature, extending from the interface with the electrolytic medium toward the upper part of the cell.

The electrolysis is itself carried out continuously, on the one hand with the continuous introduction of the mixture of molten salts comprised of lithium chloride as the electrolyzable material and the continuous extraction of the product metallic lithium and the mixture of molten salts simultaneously entrained, and the continuous recovery of gaseous chloride on the other.

The electrolysis is carried out without the use of a diaphragm by virtue of the rapid natural circulation of the electrolytic medium, said circulation resulting simply from the entrainment within the electrolytic medium of the chlorine bubbles generated at the anode. The electrolytic medium is entrained vertically by the ascending movement of the chlorine bubbles in the interspace located between the anode and the cathode, after which it descends to the space located beyond the cathode to recirculate within the space between the anode and the cathode. The speed of circulation of said medium is high, because if Vo is the velocity of movement of the electrolytic medium entering the cell in the absence of natural recirculation, the velocity V actually attained is approximately 250 times Vo, due to said recirculation.

To make possible this natural circulation of the electrolytic medium, the cathode is completely immersed in the electrolytic medium.

The chlorine produced by electrolysis is continuously withdrawn, without dilution by an inert gas.

Following electrolysis, the product metallic lithium may be separated by decantation from the mixture of molten salts entrained simultaneously, for example, by the method described in published French Application No. 2,560,221.

The molten salts are recycled into the electrolysis medium after the lithium chloride concentration thereof has been readjusted.

This invention also features novel apparatus for carrying out the subject process.

Such apparatus comprises an electrolytic cell including:

(i) an anode surrounded by a cathode which is completely immersed in the electrolysis medium;

(ii) inlet means for the molten salts at the base of the cell;

(iii) means for the evacuation of the gaseous chlorine formed;

(iv) means for the removal, by overflow, of the lithium formed and the molten salts simultaneously entrained; said apparatus being characterized in that the electrolytic cell is equipped on the periphery thereof:

(v) with a lower cooling system situated at any level below the level of the electrolysis bath;

(vi) and an upper cooling system situated in the lower portion of the gaseous phase including the chlorine formed, with its location being limited by the interface with the electrolysis medium; and also in that the means for the removal of the lithium formed by overflow and the simultaneously entrained molten salts is situated at the level of the interface of the electrolysis medium and the gaseous phase, at a distance from the inner wall member of the cell sufficient to enable the formation of a peripheral crust of salts solidified on said wall at the level of the interface of the electrolysis medium and the gaseous phase, while avoiding the crystallization of the medium to be removed continuously.

The anode is preferably made of graphite and is cylindrical in shape (for example, a bar); it may be sheathed (by a material such as alumina, quartz, silica, etc.) on the portion itself not immersed in the electrolysis medium and to a certain depth below the interface of the electrolysis medium and the gaseous phase.

The cathode is preferably cylindrical in shape; it may be attached to the wall of the cell by any means which do not obstruct the circulation of the electrolysis medium and which provide electrical conduction.

The means for the removal of lithium and the molten salts simultaneously entrained may, for example, comprise a chute.

The lower and upper cooling systems may be any means making it possible to obtain a temperature respectively lower than 400° C. in the electrolysis medium and less than or equal to 300° C. in the gaseous phase. Thus, on the external wall member of the cell, cooling coils or cooling collars may be used, with, for example, atmospheric air or water as the cooling medium.

The lower cooling system is typically situated at mid-height of the electrolytic bath.

In order to further illustrate the present invention and the advantages thereof, the following specific example is given (with reference to the accompanying FIGURE of Drawing), it being understood that same is intended only as illustrative and in nowise limitative.

EXAMPLE

The electrolytic cell comprised:

(i) a cylindrical stainless steel tank 1 having an internal diameter of 700 mm, a thickness of 6 mm, an approximate volume of 500 l, and a useful volume of 350 l, about ⅔ of which was occupied by the molten salts;

(ii) a cylindrical cathode 2 having a height of 800 mm and a thickness of 4 mm, made of stainless steel; it was entirely submerged in the salt bath and electrical conduction was assured by six 4 mm thick tie rods welded to the cathode and the tank;

(iii) an anode 3 defined by a graphite bar having a diameter of 300 mm, 150 cm in height and extending into the bath to a height of about 85 cm, with the interspace separating the anode and the cathode amounting to 20 mm. Power was introduced by means of a copper bar joined to the head of the anode and was returned through three tabs welded to the center of the cathode;

(iv) a lower cooling collar 4 with an air circulation of 100 $m^3$/hr, located 40 cm below the level of the bath;

(v) an upper cooling collar 5 with an atmospheric air circulation of 100 $m^3$/hr, located in the lower region of the gaseous phase, said location being limited by the level of the interface with the medium of electrolysis;

(vi) a feed inlet 6 for the mixture of molten salts communicating into the base portion of the tank;

(vii) a gas outlet 7 for the removal of chlorine gas from the upper region of the tank; and (viii) a chute outlet 8 for the removal of the lithium in admixture with the molten salts, the position of which determined the level of the bath in the cell (it was located at a distance of 3 cm from the internal wall of the cell; its width was 5 cm and its depth was 6 cm).

The electrolysis was carried out using a current of 5000 A, employing a mixture of molten LiCl/KCl salts at a temperature of 380° C. and at a flow rate of 300 l/hr; the temperature of the gaseous phase at the interface with the medium of electrolysis medium was 300° C.

The chlorine bubbles generated at the anode induced a natural circulation of the molten salts in the interspace between the electrodes on the order of 80 $m^3$/hr.

The remaining parameters of the operation were as follows:

(a) at the inlet 6 of the electrolyzer:
Flow of KCl: 274 kg/hr;
Flow of LiCl: 224 kg/hr;

(b) at the liquid chute outlet 8 of the electrolyzer:
Flow of Li: 1.2 kg/hr;

(c) at the gas outlet 7 of the electrolyzer:
Flow of $Cl_2$: 1.9 $Nm^3$/hr.

Under these conditions, it was possible to carry out the electrolysis of LiCl at a Faraday yield of 90%. The liquid exiting the electrolyzer was introduced into a decanter comprising:

(1) a decantation zone having a surface area of 0.16 $m^2$;

(2) means for the removal of the light phase consisting of the lithium, by overflow;

(3) a device for the removal of the heavy phase consisting of the mixture of molten salts, including a well and a reservoir.

The molten salts were filtered and then recycled, with addition of 170 moles/hr of LiCl, into the electrolyzer.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the continuous preparation of lithium metal, which comprises (i) continuously electrolyzing a mixture of molten salts including lithium chloride, said mixture comprising the medium of electrolysis, (ii) continuously withdrawing admixture of product lithium metal with said mixture of molten salts, and (iii) continuously discharging formed chlorine gaseous phase therefrom, wherein the medium of electrolysis is maintained at a temperature ranging from the melting point of said mixture of molten salts, at the eutectic composition thereof, to 400° C., and said gaseous chlorine phase is maintained at a temperature not exceeding 300° C.

2. The process as defined by claim 1, said medium of electrolysis naturally circulating within an interspace defined between the electrolytic electrodes, with said interspace being devoid of physical barrier between the electrodes.

3. The process as defined by claim 2, further comprising separating product lithium metal from said withdrawn admixture.

4. The process as defined by claim 2, said mixture of molten salts comprising lithium chloride and at least one other alkali or alkaline earth metal chloride.

5. The process as defined by claim 2, said mixture of molten salts being essentially eutectic in composition.

6. The process as defined by claim 4, said mixture of molten salts comprising lithium chloride and potassium chloride.

7. The process as defined by claim 2, said gaseous chlorine phase exhibiting a temperature gradient of from 300° C. to ambient.

8. The process as defined by claim 2, carried out in an electrolytic cell, and comprising establishing a peripheral protective crust of crystallized salts on the inner wall surface of said cell at the level of the gaseous phase/molten salt interface.

9. A walled electrolytic cell for the electrolysis of molten salt to elemental metal and a gaseous product of electrolysis, comprising (i) an anode and (ii) a cathode, said cathode circumferentially surrounding said anode as to define an unrestricted interspace therebetween, said cathode being adapted to establish a natural circulation of molten salt electrolytic medium within said interspace and molten metal formed by such electrolysis in admixture as a molten salt product of electrolysis, said cathode being situated as to be below the level of the electrolytic medium when the cell is in use, and said anode being partially immersed in the electrolytic medium when the cell is the electrolytic medium when the cell is in use, (iii) molten salt inlet means, (iv) means for discharging gaseous product of electrolysis, (v) means for withdrawing molten product of electrolysis, said means (v) being at the level of a gaseous phase/molten salt interface when the cell is in use and spaced such that a peripheral protective crust of crystallized salts will be established on the inner wall surface of said cell at the level of said interface, (vi) lower cooling means situated at any level below said means (v), and (vii) upper cooling means situated proximately above said means (v).

10. The electrolytic cell as defined by claim 9, said means (vi) and (vii) being adapted to establish a temperature of less than 400° C. within any circulating medium of electrolysis and a temperature not exceeding 300° C. in the gaseous product of electrolysis.

* * * * *